United States Patent [19]

Metzger

[11] 4,010,033

[45] Mar. 1, 1977

[54] PHOTOSENSITIVE LAYER AND METHOD OF FORMING A PHOTOGRAPHIC IMAGE THEREFROM

[75] Inventor: Jacques V. Metzger, Marseille, France

[73] Assignee: Agence Nationale de Valorisation de la Recherche (ANVAR), Neuilly-sur-Seine, France

[22] Filed: Mar. 10, 1976

[21] Appl. No.: 665,388

Related U.S. Application Data

[63] Continuation of Ser. No. 492,487, July 29, 1974, abandoned.

[30] Foreign Application Priority Data

Aug. 3, 1973 France ..... 73.28538

[52] U.S. Cl. ..... 96/48 R; 96/48 HD; 96/90 PC; 96/89; 96/1.5; 96/1.7; 96/1.8

[51] Int. Cl.[2] ..... G03C 5/24; G03C 1/72; G03C 1/52

[58] Field of Search ..... 96/48 R, 48 HD, 90 PC, 96/89, 90 R, 1.5, 1.8, 1.7; 252/300

[56] References Cited

UNITED STATES PATENTS

| | | | |
|---|---|---|---|
| 3,322,542 | 5/1967 | Ullman et al. | 96/90 PC |
| 3,510,308 | 5/1970 | Foris et al. | 96/90 PC |
| 3,642,479 | 2/1972 | Van Allan et al. | 96/90 PC |
| 3,810,763 | 5/1974 | Laridon et al. | 96/90 PC |

*Primary Examiner*—Won H. Louie, Jr.
*Attorney, Agent, or Firm*—Brooks Haidt Haffner & Delahunty

[57] ABSTRACT

A photosensitive layer comprises (a) at least one heterocyclic photochromic spiropyrane which can exist in a closed or open structure, the closed structure being converted to the open structure on irradiation with ultra-violet light, and the open structure being reconverted to the closed structure on irradiation with visible light, (b) at least one ortho-substituted nitrogen-containing thioether, and (c) at least one reagent capable of developing a latent image produced in the layer. In use of the layer, it is exposed to ultra-violet or visible light, and after exposure the layer is heated to cause conversion of the thioether to a thione at those areas of the layer in which spiropyrane in the open form is present: the spiropyrane in the open form catalyzing the conversion of thioether to thione and thereby amplifying the latent image produced on irradiation of the layer. The thione produced then reacts with the developing reagent to form a visible image.

22 Claims, 3 Drawing Figures

PHOTOSENSITIVE LAYER AND METHOD OF FORMING A PHOTOGRAPHIC IMAGE THEREFROM

Figure 1:
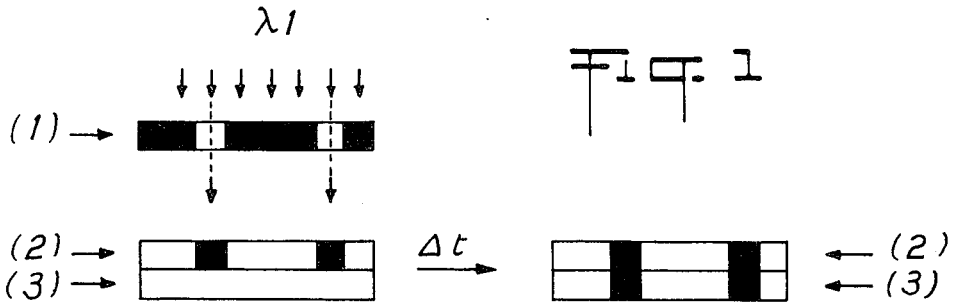

This is a continuation of application Ser. No. 492,487, filed July 29, 1974, now abandoned.

The present invention relates to a photosensitive layer, and to a method for producing a positive or negative photographic image using the photosensitive layer.

Photosensitive compositions containing silver complexes of 2-thio-4-thiazolines which are substituted in the 3-position and which possess an acidic hydrogen in the 3-position are already known. The use of such compositions makes it unnecessary to fix unreduced silver halides by means of a solvent. However, the conventional developing steps are not eliminated: it is necessary to use a chemical developer in order to develop the image.

The photochromic properties of spiropyranes and their application in particular in the photographic field are also known: by exposing spiropyranes in the closed form to ultra-violet rays, the corresponding coloured photomerocyanine is obtained. The problem is that the image which is obtained is only transient, because visible radiation gradually destroys it, regenerating the spiropyrane in the closed form. Difficulties in fixing the photomerocyanine arise so that it is difficult to exploit the photochromic properties of spiropyranes.

We have now developed a photosensitive layer which, in use, utilises the photochromic properties of spiropyranes and amplifies them by employing one of the two forms of the spiropyrane to act as a catalyst for another reaction.

According to the invention, there is provided a photosensitive layer which comprises:

a. at least one heterocyclic photochromic spiropyrane which can exist in two forms and is selectively converted from one form to the other on irradiation according to the scheme:

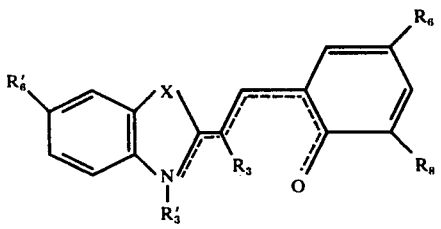

wherein $R_3$ is methyl, phenylthio, phenyl, chloro, bromo, methoxy, hydroxy, naphthyl, 4-chloro-phenyl, 4-bromophenyl, 4-hydroxy-phenyl, or 4-methoxy-phenyl;

$R_3'$ is methyl, isopropyl, n-hexyl, benzyl, or phenylethyl;

$R_6$ is nitro;

$R_6'$ is hydrogen, oxygen, or phenylthio;

$R_8$ is methoxy or oxygen; and

X is thio, seleno, imido, oxo, aza, or dialkylcarbo, b. at least one ortho-substituted nitrogen-containing heterocyclic thioether of the following formula:

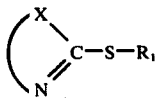

wherein

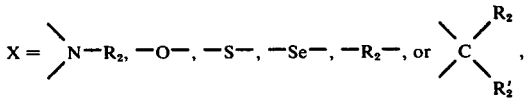

and $R_1$, $R_2$ and $R_2'$ are alkyl or acylalkyl groups, the open form of the spiropyrane being capable of acting as a catalyst in the conversion of the thioether to a thione in accordance with the following reaction:

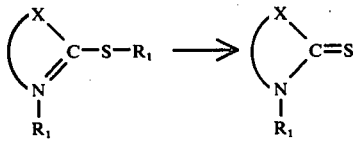

so that a latent image produced on exposure of the spiropyrane to light is amplified, and c. at least one reagent for developing the amplified latent image.

The developing and fixing steps which customarily require the use of additional chemicals which react with the constituents of the sensitive layer are not necessary when the photosensitive layer of the invention is employed, since developing and fixing take place in situ.

The latent image is developed by the reaction of the developing reagent with the thione formed from the thioether, to produce a visible and stable image. The photosensitive layers of the invention may be used to form a positive or negative photographic image, and have good sensitivity and high resolution.

In order to produce a photographic image by means of the photosensitive layer according to the invention, the layer is exposed either to ultra-violet radiation if the layer initially contains a spiropyrane in the closed form (formula I above), or to visible radiation if the layer initially contains a spiropyrane in the open form (formula II above). This produces a latent image due to selective conversion of the spiropyrane from one form to the other at the points affected by the radiation.

The layer is then heated preferably to a temperature of from 100° to 140° C in order to amplify the latent image by catalytic conversion of the amplifying reagent (the thioether) to the thione, and a image is formed as a result of reaction between the thione and the developer.

Use of the photosensitive layer of the invention enables a considerably higher quantum yield to be attained than that usually achieved. The layer of the invention requires the use of fewer photons than in known techniques, because only a small quantity of spiropyrane is required in order to catalyse the conversion of the thioether to the thione.

The rate at which thioether is catalytically converted to thione can be controlled by varying the temperature. The temperature necessary to enable the reaction to take place satisfactorily is considerably above ambient temperature, and this makes it possible to store a photosensitive layer containing the spiropyrane in the open form at room temperature, since the open form of the spiropyrane does not catalyse conversion of the thioether at ambient temperature.

With the photosensitive layer of the invention two different processes for forming a photographic image may be employed:

the first, involving a direct image, either negative from a negative or positive from a positive, is effected by exposing a layer containing the spiropyrane in the open form to visible radiation, and the second, involving a reverse image, either negative from a positive or positive from a negative, is effected by exposing a photosensitive layer containing the spiropyrane in the closed form to ultra-violet radiation.

By means of the invention, it is possible to form images in the form of thione complexes which absorb either in the ultra-violet range or in the visible range.

The term "photosensitive layer" includes any product which contains the specified constituents in one or more layers. The heterocyclic spiropyrane may be in the "open" or "closed" form depending on the radiation to which it is to be exposed.

Preferred spiropyranes are of the benzothiazoline, benzoseleniazoline, benzoxazoline, benzoimidazoline and benzoindoline type, which are preferably substituted by the radicals given in the following table:

| $R_3$ | $R_6$ | $R_8$ | $R_3'$ | R' |
|---|---|---|---|---|
| $CH_3$ | $NO_2$ | $OCH_3$ | $CH_3$ | H |
| $-S-C_6H_5$ | $NO_2$ | $OCH_3$ | $CH_3$ | H |
| $C_6H_5$ | $NO_2$ | $OCH_3$ | $CH_3$ | H |
| Cl | $NO_2$ | $OCH_3$ | $CH_3$ | H |
| Br | $NO_2$ | $OCH_3$ | $CH_3$ | H |
| $OCH_3$ | $NO_2$ | $OCH_3$ | $CH_3$ | H |
| OH | $NO_2$ | $OCH_3$ | $CH_3$ | H |
| $CH_3$ | $NO_2$ | O | $CH_3$ | O |
| $CH_3$ | $NO_2$ | $OCH_3$ | $CH_3$ | O |
| $CH_3$ | $NO_2$ | O | $CH_3$ | $S-CH_3$ |
| $CH_3$ | $NO_2$ | $OCH_3$ | $CH_3$ | $S-CH_3$ |
| $CH_3$ | $NO_2$ | $OCH_3$ | isopropyl, n-hexyl, benzyl or phenylethyl | O |
| naphthyl, cyclohexyl, phenylthio, phenyl, 4-chloro-phenyl, 4-bromo-phenyl, 4-hydroxy-phenyl or 4-methoxyphenyl | $NO_2$ | $OCH_3$ | $CH_3$ | O |
| $CH_3$ | $NO_2$ | $OCH_3$ | $CH_3$ | $S-CH_3$ |

Preferred thioethers for use in a photosensitive layer of the invention include 2-alkylthio- and 2-acylmethylthio-benzothiazoles and -benzoxazoles, and 2-alkylthio- and 2-acylmethylthio-N-alkyl-imidazoles and -thiazoles.

The reagent for developing the image is preferably either (a) a metal salt of a carboxylic acid which an be reduced by thiones, or (b) a zinc, cobalt, or nickel halide or zinc or cobalt thiocyanate.

Preferred metal salts of carboxylic acids are silver, cadmium, calcium, copper, cobalt, tin, magnesium, manganese, nickel, lead, and zinc behenates, resinates, naphthenates, benzoates and stearates.

When a developer of type (b) is employed, a complex of the formula $ML_2$ is formed where M represents the metal halide or thiocyanate and L represents the thione.

It is possible to add to the three above mentioned essential constituents of the photosensitive layer another constituent which makes it possible to fix the spiropyrane in the open form in order to prevent it from being destroyed when the layer is heated in order to amplify and develop the image. This optional constituent may be either a metal salt or a semi-conducting metal oxide.

Preferred metal salts which may be employed for this purpose include cobalt, copper and nickel salts which form a complex with the open form of the spiropyrane. These salts may also be used to dope the metal oxides.

Amongst the metal oxides which possess semi-conducting properties, titanium oxide and zinc oxide are preferred. These oxides can be suitably doped and rendered sensitive in the visible. Experience has shown that excellent results are obtained with titanium oxide doped with copper, and with zinc oxide doped with nickel or with nickel in cerium.

A preferred method of doping the titanium or zinc oxides is as follows:

The oxide particles are paddled, with stirring, for about ten minutes in a 1% solution of copper sulphate (or in a 0.78% solution of nickel chloride). The oxide particles are filtered off and dried. They are then subjected to a heat treatment which consists, in the case of titanium oxide, of heating at 100° C for 1 hour followed by heating at 420° C for 4 hours, and, in the case of zinc oxide, heating at 100° C for 1 hour followed by heating at 450° C for 5 hours.

This doping operation renders the semi-conductor sensitive to visible light and no longer to ultra-violet light. The semi-conductor will thus be able to absorb photons from visible light, and this modifies its electronic structure and enables it to fix the open form of the spiropyrane.

A further purpose of the semi-conducting metal oxide is to act as an adsorbent of the spiropyrane and the thioethers. The adsorption may be effected in a liquid medium: the various constituents of the photosensitive layer are dissolved in a suitable solvent which is later removed by evaporation. This adsorption by the semi-conductor imparts great sensitivity and high resolution to the photosensitive layer.

The invention also comprises a method of making a photosensitive layer of the invention comprising a semi-conducting metal oxide, which comprises mixing a spiropyrane as defined above, a thioether as defined above in a solvent, adding particles of the semi-conducting metal oxide to the solution obtained, stirring the mixture vigorously for at least ten minutes in order to adsorb the spiropyrane and thioether on the metal oxide particles, adding a solution of a binder containing the developer, stirring for at least ten minutes, spreading the mixture in the form of a thin layer on a physical support, and evaporating the solvent.

The various constituents of a photosensitive layer of the invention can be combined to form a single photosensitive layer. A method of making such a layer is illustrated by the following example:

100 mg of spiropyrane were dissolved in 100 $cm^3$ of solvent (two-thirds toluene and one-third ethanol). 55 g of titanium oxide were added. Mixing was effected, with vigorous stirring, for approximately ten minutes. 500 mg of thioether were added. The mixture was rendered homogeneous. 20 g of resin binder in solution containing small particles of particle size 2 to 5$\mu$ of a metal salt of a carboxylic acid which can be reduced by thiones were then added. Mixing was effected for approximately ten minutes.

The viscous composition obtained was then spread in the form of a thin film on a solid support, which may, for example, be paper, a plastics material or metal. The solvent was then evaporated.

If it is desired to make a photosensitive layer comprising two superposed layers, the first layer covering the support and containing the thioether and the metal salt (developing reagent), and the second layer, covering the first so that incident radiation will initially impinge on the second layer, the second layer containing the spiropyrane and the semi-conducting metal oxide or the metal salt which can fix the spiropyrane in the open form, the constituents of each layer may be mixed separately and the layers formed successively, the second layer being applied to the first layer when the latter is dry.

Figure 2:
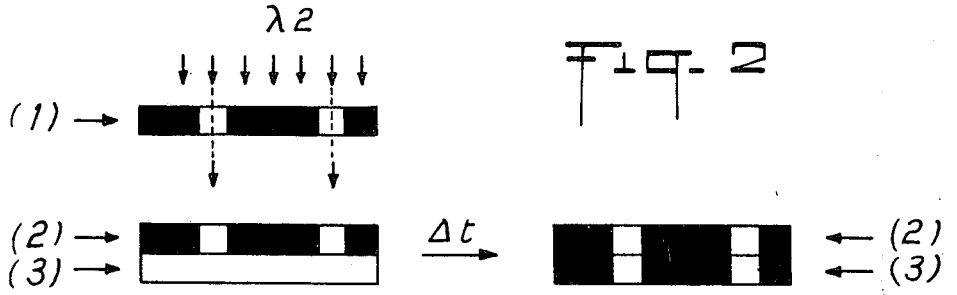
Figure 3:
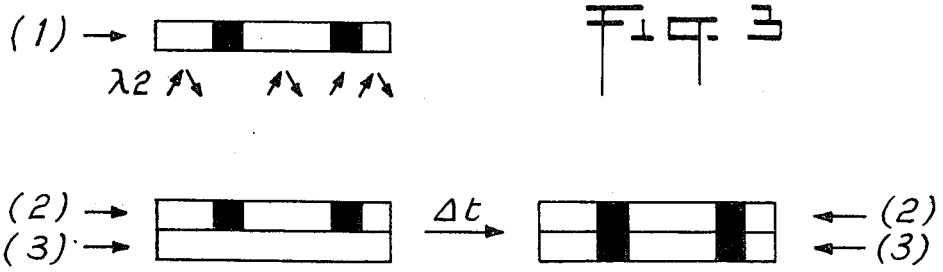

In order that the invention may be more fully understood, reference is made, by way of example, to the accompanying drawings, in which:

FIG. 1 illustrates schematically one preferred method according to the invention for producing a positive image from a negative by reversal, FIG. 2 illustrates schematically a preferred method according to the invention for producing a negative image directly from a negative, and FIG. 3 illustrates schematically a preferred method according to the invention for producing a positive image of an article.

In the Figures, the photosensitive layer is shown as two separate, adjacent and superposed layers. This arrangement is, however, only one preferred embodiment of the layer of the invention, and the layer may consist of one layer only which contains all the constituents.

FIG. 1 shows a photosensitive layer comprising the following constituents:

at (2), a spiropyrane in the closed form, and at (3), an amplifying reagent (thioether) and a developing reagent for forming the image.

In FIGS. 2 and 3, the constituents of the photosensitive layer differ from the above in that the spiropyrane at (2) is in the open form.

With reference to FIG. 1, the photosensitive layer is irradiated through the negative (1) using a wavelength $\lambda_1$ in the ultra-violet range. The exposure time necessary may range from a few seconds to a few minutes, depending on the nature of the constituents in the layer. The radiation passes through only the transparent areas of the negative and reaches the corresponding areas of layer (2) and converts the spiropyrane in the closed form (formula I above) in those areas to the photomerocyanine (formula II above).

The photomerocyanine in the open form is then used to catalyse the conversion of the ortho-substituted nitrogen-containing heterocyclic thioether to a thione in accordance with the following reaction:

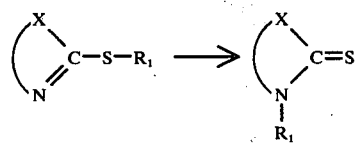

Since this conversion takes place at a temperature which is preferably between 100° and 140° C, this reaction is a chain reaction, the catalyst being regenerated and the rate being a function of the temperature. Experiments have been carried out at temperatures below 100° C, but the reaction is then much too slow. On the other hand, if the reaction is carried out at 120° C, conversion of 50% of the amplifying reagent is achieved in a few minutes.

The metal salt (the developer) present at (3) then reacts with the thione to form a visible and stable image.

Two different reactions can be carried out in order to produce a visible image. The first consists of reducing, by means of the thione, one or more metal salt(s) of carboxylic acids such as silver, cadmium, calcium, copper, cobalt, tin, magnesium, manganese, nickel, lead and zinc behenates, resinates, naphthenates, benzoates and stearates.

The metal salt or salts are preferably used in the form of very fine particles a few microns in size, for example from 2 to 5 microns, and the particles are dispersed in a suitable binder. Polyvinyl alcohol, methyl-cellulose, hydroxymethyl-cellulose, polyvinylpyrrolidone and styrene-butadiene copolymers of the "pliolite" type may be mentioned as examples of suitable binder.

The reduction reaction is facilitated by heating the sensitive layer to a temperature above the melting point of the metal salt of the carboxylic acid so as to permit the ionic mobility which is necessary for reduction by means of the thione to take place.

The second method of forming the visible image involves the formation of a complex of the thione with a salt such as zinc, cobalt or nickel chloride, bromide or iodide, or zinc or cobalt thiocyanate. In the presence of a thione, such salts form a complex of the 1:2 type, containing one molecule of metal salt per two molecules of coordinating group.

We have found that complexes of the formula $ZnCl_2L_2$, $ZnBr_2L_2$, $ZnI_2L_2$ and $Zn(NCS)_2L_2$ absorb in the ultra-violet range, and complexes of the formula $CoCl_2L_2$, $CoBr_2L_2$, $CoI_2L_2$, $Co(NCS)_2L_2$, $NiCl_2L_2$, $NiBr_2L_2$ and $NiI_2L_2$ absorb in the visible range.

With reference to FIGS. 2 and 3, the spiropyrane at (2) is the open form, and the layer is irradiated using a wavelength $\lambda_2$ in the visible range.

In the case of FIG. 2, the starting material is a negative. The incident radiation passes through the negative only at the places which allow it to pass and impinges on the corresponding areas of layer (2). The spiropyrane in these areas of layer (2) is converted to spiropyrane in the closed form (formula I above).

In the areas of layer (2) on which the radiation does not impinge the spiropyrane remains in the open form (formula II) and will act as a catalyst for initiating the amplifying reaction to form a thione which, in its turn, will react with the metal salt(s) of the developer to form a negative image.

In the case of FIG. 3, the article to be reproduced is irradiated with rays of wavelength $\lambda_2$ in the visible range, and the rays after reflection from the clear areas of the article, will strike the corresponding regions of the photosensitive layer, causing the spiropyrane in the open form in these regions to change into the closed form. In the areas of layer (2) on which the rays do not impinge the spiropyrane remains, in the open form, which will initiate the conversion of the amplifying reagent to a thione, and the thione will then react with the developer to produce a stable and visible image reproducing the article in a positive representation.

What is claimed is:

1. A photographic element comprising a support having thereon a photosensitive layer which contains:

a. at least one heterocyclic photochromic spiropyrane which can exist in two forms and is selectively converted from one form to the other on irradiation according to the scheme

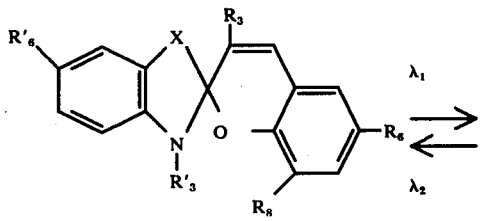

(I)

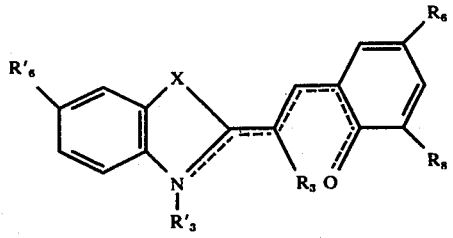

(II)

wherein $R_3$ is methyl, phenylthio, phenyl, chloro, bromo, methoxy, hydroxy, naphthyl, 4-chlorophenyl, 4-bromophenyl, 4-hydroxyphenyl, or 4-methoxyphenyl;

$R_3'$ is methyl, isopropyl, n-hexyl, benzyl, or phenylethyl;

$R_6$ is nitro;

$R_6'$ is hydrogen, methylthio or phenylthio;

$R_8$ is methoxy; and

X is thio, seleno, imido, oxo, aza, or dialkylcarbo;

$\lambda_1$ is a wavelength in the ultraviolet range and $\lambda_2$ is a wavelength in the visible range;

b. at least one ortho-substituted nitrogen-containing heterocyclic thioether of the following formula:

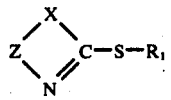

wherein

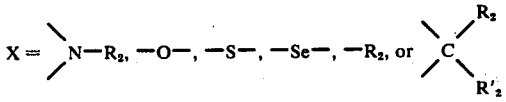

Z is a group of atoms required to complete a five-membered ring or a five-membered substituted ring, $R_1$, $R_2$, and $R_2'$ are alkyl or acylalkyl groups, the open form of the spiropyrane being capable of acting as a catalyst in the conversion of the thioether to a thione in accordance with the following reaction:

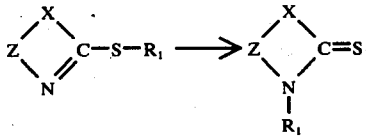

so that a latent image produced on exposure of the spiropyrane to light is amplified, c. at least one agent for producing a visible image from the amplified latent image, such agent comprising 1. at least one metal salt of a carboxylic acid which can be reduced by thiones and is a behenate, resinate, naphthenate, benzoate, or stearate of silver, cadmium, calcium, copper, cobalt, tin, manganese, magnesium, nickel, lead, or zinc, or 2. at least one compound which together with the thione, forms a complex of the formula:

$ML_2$ where M represents halide or thiocyanate and L represents the thione, and is zinc, cobalt, or nickel halide or zinc or cobalt thiocyanate, and d. at least one component which will fix the spiropyrane in the open form, such component being a semiconducting oxide or a cobalt, copper, or nickel salt.

2. An element according to claim 1, in which the spiropyrane is of the benzothiazoline type.

3. An element according to claim 1, in which the thioether is a 2-alkylthiobenzothiazole.

4. An element according to claim 1, in which the thioether is a 2-alkylthiobenzoxazole.

5. An element according to claim 1, in which the thioether is a 2-acylmethylthiobenzothiazole.

6. An element according to claim 1, in which the thioether is a 2-acylmethylthiobenzoxazole.

7. An element according to claim 1, in which the thioether is a 2-alkylthio-N-alkyl-imidazole.

8. An element according to claim 1, in which the thioether is a 2-alkylthio-N-alkyl-thiazole.

9. An element according to claim 1, in which the thioether is a 2-acylmethylthio-N-alkyl-imidazole.

10. An element according to claim 1, in which the thioether is a 2-acylmethylthio-N-alkyl-thiazole.

11. An element according to claim 1 which comprises a semiconducting metal oxide selected from the group consisting of titanium oxide and zinc oxide.

12. An element according to claim 11, in which the semiconducting metal oxide is titanium oxide which has been doped with copper to render it sensitive to visible light.

13. An element according to claim 11, in which the semiconducting metal oxide is zinc oxide, which has been doped with nickel to render it sensitive to visible light.

14. An element according to claim 11, in which the semiconducting metal oxide is zinc oxide, which has been doped with nickel and cerium to render it sensitive to visible light.

15. An element according to claim 11, in which the spiropyrane and the thioether are adsorbed on the surface of the particles of the semiconducting metal oxide.

16. An element according to claim 1, which comprises a salt selected from the group consisting of cobalt, copper or nickel salts which can form a complex with the said catalyst in order to fix it.

17. A method of forming a reverse photographic image using a photographic element as claimed in claim 1, in which the spiropyrane is in the closed form, which comprises imagewise exposing the photosensitive layer of the element to ultra-violet radiation, so as to convert the spiropyrane in those parts of the layer on which the ultra-violet radiation is incident to the open form, and thereby produce a latent image.

18. A method of forming a direct photographic image using a photographic element as claimed in claim 1, in which the spiropyrane is in the open form, which comprises imagewise exposing the photosensitive layer of the element to visible radiation so as to convert the spiropyrane in those parts of the layer on which the visible radiation is incident to the closed form, and thereby produces a latent image.

19. A method according to claim 17, in which the exposed photographic element is heated to a temperature of from about 100° to about 140° C in order to amplify the latent image by catalytic conversion of the thioether to a thione, and to form a visible image as a result of reaction between the thione so produced and the reagent for developing the amplified latent image.

20. A method according to claim 18, in which the exposed photographic element is heated to a temperature of from about 100° to about 140° C in order to amplify the latent image by catalytic conversion of the thioether to a thione, and to form a visible image as a result of reaction between the thione so produced and the reagent for developing the amplified latent image.

21. A method of making the photosensitive layer as claimed in claim 15, which comprises mixing a spiropyrane having the formula in one form

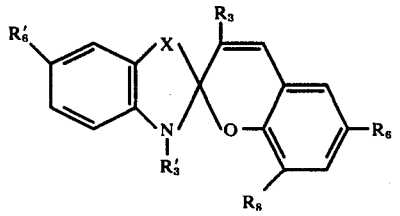

wherein $R_3$ is methyl, phenylthio, phenyl, chloro, bromo, methoxy, hydroxy, naphthyl, 4-chloro-phenyl, 4-bromo-phenyl, 4-hydroxy-phenyl, or 4-methoxy-phenyl;

$R_3'$ is methyl, isopropyl, n-hexyl, benzyl or phenylethyl;

$R_6$ is nitro;

$R_6'$ is hydrogen, methylthio or phenylthio;

$R_8$ is methoxy; and

X is thio, seleno, imido, oxo, aza, or dialkylcarbo, and at least one ortho-substituted nitro-containing heterocyclic ether having the formula

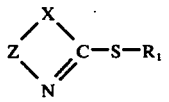

where

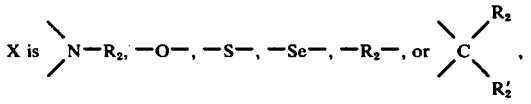

Z is a group of atoms required to complete a five-membered ring or a five-member substituted ring, and $R_1$, $R_2$ and $R_2'$ are alkyl or acylalkyl groups, the open form of the spiropyrance being capable of acting as a catalyst in the conversion of the thioether to a thione in accordance with the following reaction:

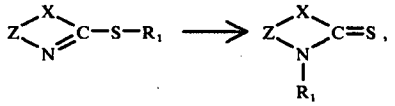

in a solvent, adding particles of the semiconducting metal oxide to the solution so produced, vigorously stirring the mixture for at least about ten minutes in order to absorb the spiropyrane and thioether on the metal oxide particles, adding a solution of a binder containing said reagent for developing the amplified latent image, stirring for at least about ten minutes, spreading the mixture as a thin layer on a physical support and evaporating the solvent.

22. An element according to claim 1 wherein $R_6'$ is methylthio.

* * * * *

UNITED STATES PATENT AND TRADEMARK OFFICE

CERTIFICATE OF CORRECTION

PATENT NO. : 4,010,033

DATED : March 1, 1977

INVENTOR(S) : JACQUES V. METZGER

It is certified that error appears in the above-identified patent and that said Letters Patent are hereby corrected as shown below:

Column 1, line 45, correct the equation to appear as follows:

--

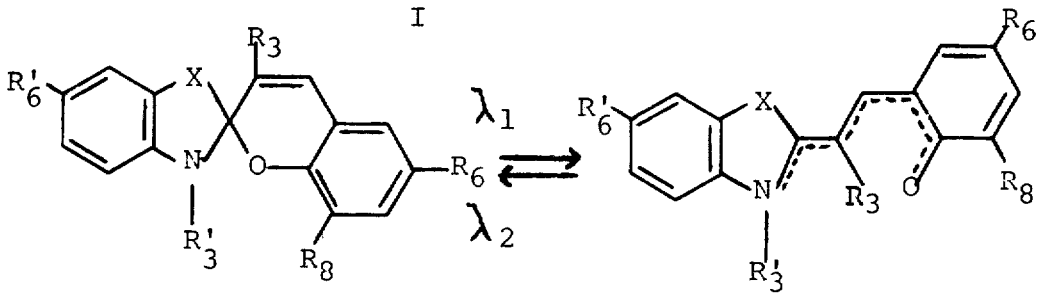

--

Column 2, line 55, after "a" insert --visible--.

Column 3, line 29, change "R'" (last column of Table) to --$R'_6$--.

Column 6, line 67, after "is" (first occurrence) insert --in--.

Column 9, line 44, change "produces" to --produce--.

Column 10, line 55, "absorb" should read -- adsorb --.

Signed and Sealed this

Third Day of October 1978

[SEAL]

Attest:

RUTH C. MASON
Attesting Officer

DONALD W. BANNER
Commissioner of Patents and Trademarks